US011335243B2

(12) United States Patent
Zheng et al.

(10) Patent No.: US 11,335,243 B2
(45) Date of Patent: May 17, 2022

(54) DISPLAY PANEL AND DISPLAY DEVICE

(71) Applicant: BOE Technology Group Co., Ltd., Beijing (CN)

(72) Inventors: Haoliang Zheng, Beijing (CN); Minghua Xuan, Beijing (CN); Dongni Liu, Beijing (CN); Ning Cong, Beijing (CN); Zhenyu Zhang, Beijing (CN); Lijun Yuan, Beijing (CN); Yi Ouyang, Beijing (CN); Guangliang Shang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/904,585

(22) Filed: Jun. 18, 2020

(65) Prior Publication Data

US 2021/0027699 A1 Jan. 28, 2021

(30) Foreign Application Priority Data

Jul. 22, 2019 (CN) ..... 201910661832.0

(51) Int. Cl.
*G09G 3/32* (2016.01)

(52) U.S. Cl.
CPC ..... *G09G 3/32* (2013.01); *G09G 2310/0267* (2013.01); *G09G 2310/0275* (2013.01); *G09G 2310/0286* (2013.01)

(58) Field of Classification Search
CPC ..... G09G 3/3233; G09G 3/3266; G09G 2320/0233; G09G 3/3225; G09G 3/3258;
(Continued)

(56) References Cited

U.S. PATENT DOCUMENTS

2005/0057454 A1* 3/2005 Jang ..... G09G 3/3258 345/76
2015/0243208 A1* 8/2015 Kim ..... G09G 3/3225 345/204

(Continued)

FOREIGN PATENT DOCUMENTS

CN 108206009 A 6/2018
CN 108287407 A 7/2018

(Continued)

OTHER PUBLICATIONS

Office Action dated Jun. 1, 2020 for Chinese Patent Application No. 201910661832.0 and English Translation.

(Continued)

*Primary Examiner* — Duc Q Dinh
(74) *Attorney, Agent, or Firm* — Ling Wu; Stephen Yang; Ling and Yang Intellectual Property

(57) ABSTRACT

Disclosed are a display panel and a display device. The display panel includes M rows and N columns of pixel units. The display panel is divided into R regions along a column direction, and an i-th region includes: (1+M(i−1)/R)-th row to a (Mi/R)-th row of pixel units. The display panel further includes M shift registers, M light emitting drivers, R light emitting control scan staring signal terminals, R scan start signal terminals for controlling time length and R scan start signal terminals for controlling current. An i-th row of pixel units is connected with an i-th shift register and an i-th light emitting driver, a light emitting driver connected to a first row of pixel units in the i-th region is connected with an i-th scan start signal terminal for controlling light emission.

20 Claims, 9 Drawing Sheets

(58) Field of Classification Search
CPC ... G09G 2320/0626; G09G 2300/0439; G09G 2310/0286; G09G 2300/046; G09G 2310/0205; G09G 3/3406; G09G 2310/061; G09G 2310/0289; G09G 3/3666; G09G 2300/0426; G09G 2310/0267; G09G 2300/0838; G09G 2310/0213; G09G 2310/0281; G09G 2320/0646; G06F 3/04166
See application file for complete search history.

(56) References Cited

U.S. PATENT DOCUMENTS

2015/0316976 A1* 11/2015 Toyotaka ..... G06F 1/1641 361/679.27
2016/0225311 A1* 8/2016 Hwang ..... G09G 3/3208
2018/0075791 A1* 3/2018 Li ..... G09G 3/006
2018/0174525 A1 6/2018 Kim et al.
2018/0197480 A1 7/2018 Choi et al.
2018/0197481 A1* 7/2018 Choi ..... G09G 3/3266
2020/0058250 A1 2/2020 Dong et al.

FOREIGN PATENT DOCUMENTS

CN 108538241 A 9/2018
CN 109036281 A 12/2018
CN 109860271 A 6/2019

OTHER PUBLICATIONS

Office Action dated Oct. 23, 2020 for Chinese Patent Application No. 201910661832.0 and English Translation.

* cited by examiner

DISPLAY PANEL AND DISPLAY DEVICE

CROSS-REFERENCE TO RELATED APPLICATION

This application claims priority of Chinese patent application No. 201910661832.0 filed to CNIPA on Jul. 22, 2019, the content of which is hereby incorporated by reference.

TECHNICAL FIELD

The present disclosure relates to, but is not limited to, the technical field of display, in particular, a display panel and a display device.

BACKGROUND

A Micro Light-Emitting Diode (Micro LED) is expected to become a next generation of mainstream display technology due to advantages of small size, low power consumption and long product life of the Micro LED.

A display product includes multiple sub-pixels. Each sub-pixel includes a Micro LED and a pixel circuit. The pixel circuit is configured to provide driving current to the Micro LED in the sub-pixel to enable the Micro LED to emit light and realize display. In addition, the display product further includes a shift register and a light emission controller, the shift register and the light emission controller are configured to provide driving signals to the pixel circuit to realize a driving process of the pixel circuit.

SUMMARY

The following is a summary of the subject matter described in detail in the present disclosure herein. This summary is not intended to limit a protection scope of the claims.

In a first aspect, the present disclosure provides a display panel including: M rows and N columns of pixel units, the display panel is divided into R regions along a column direction, and an i-th region includes: a (1+M(i−1)/R)-th row to a (Mi/R)-th row of pixel units. The display panel further includes: M shift registers, M light emitting drivers, R scan start signal terminals for controlling light emission, R scan start signal terminals for controlling time length, and R scan start signal terminals for controlling current.

An i-th row of pixel units is connected with an i-th shift register and an i-th light emitting driver, a light emitting driver connected to a first row of pixel units in the i-th region is connected with an i-th scan start signal terminal for controlling light emission, a shift register connected to the first row of pixel units in the i-th region is connected with an i-th scan start signal terminal for controlling time length and an i-th scan start signal terminal for controlling current, $1 \le i \le R$, $R \ge 2$, $M \ge R$, and $N \ge 1$.

In some possible implementations, the pixel unit includes a light emitting element and a pixel circuit configured to drive the light emitting element to emit light.

In some possible implementations, the pixel circuit includes a sub-circuit for controlling current and a sub-circuit for controlling time length.

The sub-circuit for controlling current is connected with a reset signal terminal, a first power supply terminal, a light emission control terminal, a data signal terminal for controlling current, a scan signal terminal for controlling current, an initial signal terminal and the sub-circuit for controlling time length, and is configured to output driving current to the sub-circuit for controlling time length under control of the reset signal terminal, the light emission control terminal and the scan signal terminal for controlling current.

The sub-circuit for controlling time length is connected with a ground terminal, a data signal terminal for controlling time length, a scan signal terminal for controlling time length and the light emitting element, and is configured to provide driving current to the light emitting element under control of the scan signal terminal for controlling time length.

In some possible implementations, the light emitting element is connected with a second power supply terminal.

In some possible implementations, for each pixel unit, the light emission control terminal is connected with a light emitting driver to which the pixel unit is connected.

In some possible implementations, for each pixel unit, the scan signal terminal for controlling current is connected with a shift register to which the pixel unit is connected.

In some possible implementations, for each pixel unit, the scan signal terminal for controlling time length is connected with a shift register to which the pixel unit is connected.

In some possible implementations, the sub-circuit for controlling current includes a first transistor, a second transistor, a third transistor, a fourth transistor, a fifth transistor, a driving transistor, and a first capacitor.

A control pole of the first transistor is connected with the reset signal terminal, a first pole of the first transistor is connected with the initial signal terminal, and a second pole of the first transistor is connected with a first node.

A control pole of the second transistor is connected with the scan signal terminal for controlling current, a first pole of the second transistor is connected with the data signal terminal for controlling current, and a second pole of the second transistor is connected with a second node.

A control pole of the third transistor is connected with the scan signal terminal for controlling current, a first pole of the third transistor is connected with the first node, and a second pole of the third transistor is connected with a third node.

A control pole of the fourth transistor is connected with the light emission control terminal, a first pole of the fourth transistor is connected with the first power supply terminal, and a second pole of the fourth transistor is connected with the second node.

A control pole of the fifth transistor is connected with the light emission control terminal, a first pole of the fifth transistor is connected with the third node, and a second pole of the fifth transistor is connected with a fourth node.

A control pole of the driving transistor is connected with the first node, a first pole of the driving transistor is connected with the second node, and a second pole of the driving transistor is connected with the third node.

A first terminal of the first capacitor is connected with the first node, and a second terminal of the first capacitor is connected with the first power supply terminal.

In some possible implementations, the sub-circuit for controlling time length includes a sixth transistor, a seventh transistor, and a second capacitor.

A control pole of the sixth transistor is connected with the scan signal terminal for controlling time length, a first pole of the sixth transistor is connected with the data signal terminal for controlling time length, and a second pole of the sixth transistor is connected with a fifth node.

A control pole of the seventh transistor is connected with the fifth node, a first pole of the seventh transistor is connected with the fourth node, and a second pole of the seventh transistor is connected with the light emitting element.

A first terminal of the second capacitor is connected with the fifth node, and a second terminal of the second capacitor is connected with the ground terminal.

In some possible implementations, the sub-circuit for controlling current includes a first transistor, a second transistor, a third transistor, a fourth transistor, a fifth transistor, a driving transistor and a first capacitor, and the sub-circuit for controlling time length includes a sixth transistor, a seventh transistor and a second capacitor.

A control pole of the first transistor is connected with the reset signal terminal, a first pole of the first transistor is connected with the initial signal terminal, and a second pole of the first transistor is connected with a first node.

A control pole of the second transistor is connected with the scan signal terminal for controlling current, a first pole of the second transistor is connected with the data signal terminal for controlling current, and a second pole of the second transistor is connected with a second node.

A control pole of the third transistor is connected with the scan signal terminal for controlling current, a first pole of the third transistor is connected with the first node, and a second pole of the third transistor is connected with a third node.

A control pole of the fourth transistor is connected with the light emission control terminal, a first pole of the fourth transistor is connected with the first power supply terminal, and a second pole of the fourth transistor is connected with the second node.

A control pole of the fifth transistor is connected with the light emission control terminal, a first pole of the fifth transistor is connected with the third node, and a second pole of the fifth transistor is connected with a fourth node.

A control pole of the driving transistor is connected with the first node, a first pole of the driving transistor is connected with the second node, and a second pole of the driving transistor is connected with the third node.

A first terminal of the first capacitor is connected with the first node, and a second terminal of the first capacitor is connected with the first power supply terminal.

A control pole of the sixth transistor is connected with the scan signal terminal for controlling time length, a first pole of the sixth transistor is connected with the data signal terminal for controlling time length, and a second pole of the sixth transistor is connected with a fifth node.

A control pole of the seventh transistor is connected with the fifth node, a first pole of the seventh transistor is connected with the fourth node, and a second pole of the seventh transistor is connected with the light emitting element.

A first terminal of the second capacitor is connected with the fifth node, and a second terminal of the second capacitor is connected with the ground terminal.

In some possible implementations, the light emitting element is a micro light-emitting diode.

In some possible implementations, an anode of the micro light-emitting diode is connected with the second pole of the seventh transistor, and a cathode of the micro light-emitting diode is connected with the second power supply terminal.

In some possible implementations, the display panel includes N columns of data lines, and a j-th column of pixel units is connected with a j-th column of data lines, and $1 \leq j \leq N$.

In some possible implementations, each column of data lines includes a first data line and a second data line.

A data signal terminal for controlling current of a pixel unit in an odd-numbered region is connected with the first data line, and a data signal terminal for controlling time length of the pixel unit in the odd-numbered region is connected with the second data line.

A data signal terminal for controlling current of a pixel unit in an even-numbered region is connected with the second data line, and a data signal terminal for controlling time length of the pixel unit in the even-numbered region is connected with the first data line.

In some possible implementations, the display panel further includes a first selection circuit.

The first selection circuit includes N first selection control terminals and N first selection switches, and an i-th first selection switch is connected with an i-th first selection control terminal, and a first data line and a first data terminal of an i-th column of data lines.

In some possible implementations, the display panel further includes a second selection circuit.

The second selection circuit includes N second selection control terminals and N second selection switches, and an i-th second selection switch is connected with an i-th second selection control terminal, a second data line and a second data terminal of an i-th column of data lines.

In some possible implementations, when R=2, input signals of two scan start signal terminals for controlling light emission are the same.

In some possible implementations, when R=2, input signals of two scan start signal terminals for controlling time length are the same.

In some possible implementations, when R=2, input signals of two scan start signal terminals for controlling current are the same.

In a second aspect, the present disclosure further provides a display device, and the display device includes the display panel and a protective cover plate.

The protective cover plate is positioned on a light emitting side of the display panel.

Other aspects will become apparent upon reading and understanding the drawings and detailed description.

BRIEF DESCRIPTION OF DRAWINGS

Accompanying drawings are used to provide understanding of technical solutions of the present disclosure, form a part of the specification, explain technical solutions of the present disclosure together with embodiments of the present disclosure, and do not constitute a limitation on the technical solutions of the present disclosure.

DETAILED DESCRIPTION

Figure 1A:
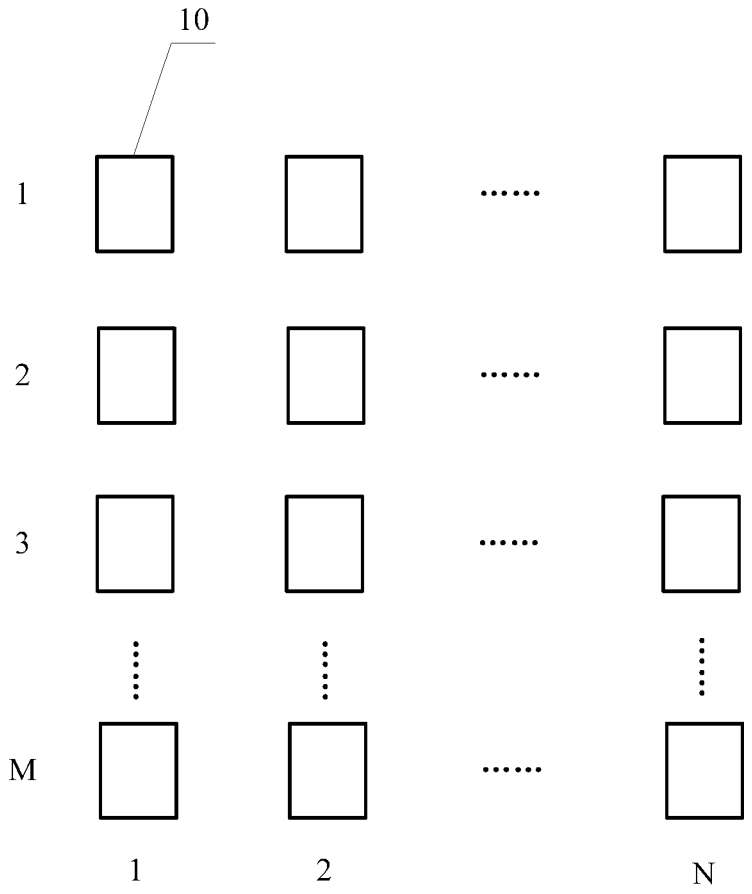
FIG. 1A is a schematic diagram of structure of a display panel according to an embodiment of the present disclosure.

Hereinafter, embodiments of the present disclosure will be described in detail with reference to the accompanying drawings. The embodiments in the present disclosure and the features in the embodiments may be combined with each other arbitrarily if there is no conflict.

The present disclosure describes multiple embodiments, but the description is exemplary rather than limiting, and for those of ordinary skill in the art, there may be more embodiments and implementations within the scope of the embodiments described in the present disclosure. Although many possible combinations of features are shown in the accompanying drawings and discussed in detail, many other combinations of the disclosed features are also possible. Unless specifically limited, any feature or element of any embodiment may be used in combination with or in place of any other feature or element of any other embodiment.

The present disclosure includes and contemplates combinations of features and elements known to those of ordinary skill in the art. Embodiments, features and elements already disclosed in the present disclosure may also be combined with any conventional features or elements to form technical solutions defined by the claims. Any feature or element of any embodiment may also be combined with features or elements from other technical solutions to form another technical solution defined by the claims. Therefore, it should be understood that any of the features shown and/or discussed in the present disclosure may be implemented individually or in any suitable combination. Therefore, the embodiments are not limited except by the limitations according to the appended claims and their equivalents. In addition, various modifications and changes may be made within the scope of protection of the appended claims.

Unless otherwise defined, technical terms or scientific terms used in the present disclosure shall have ordinary meanings understood by those of ordinary skills in the field to which the present disclosure belongs. The words "first", "second" and the like used in the present disclosure do not indicate any order, quantity or importance, but are only used to distinguish different components. The word "including", "containing", or the like means that an element or an article appearing before the word covers elements or articles listed after the word and their equivalents and does not exclude other elements or articles. The word "connected to", "connected with", or the like is not limited to physical or mechanical connections, but may include electrical connections, either in a direct or indirect manner. "Up", "Down", "Left", or "Right" and so on only indicates a relative positional relationship, and when an absolute position of a described object changes, the relative positional relationship may also change accordingly.

In a display product, a driving process of a pixel circuit takes a long time, so that a Micro LED has less time to emit light, which affects display quality of the display product and reduces yield of the good display product.

Figure 1B:
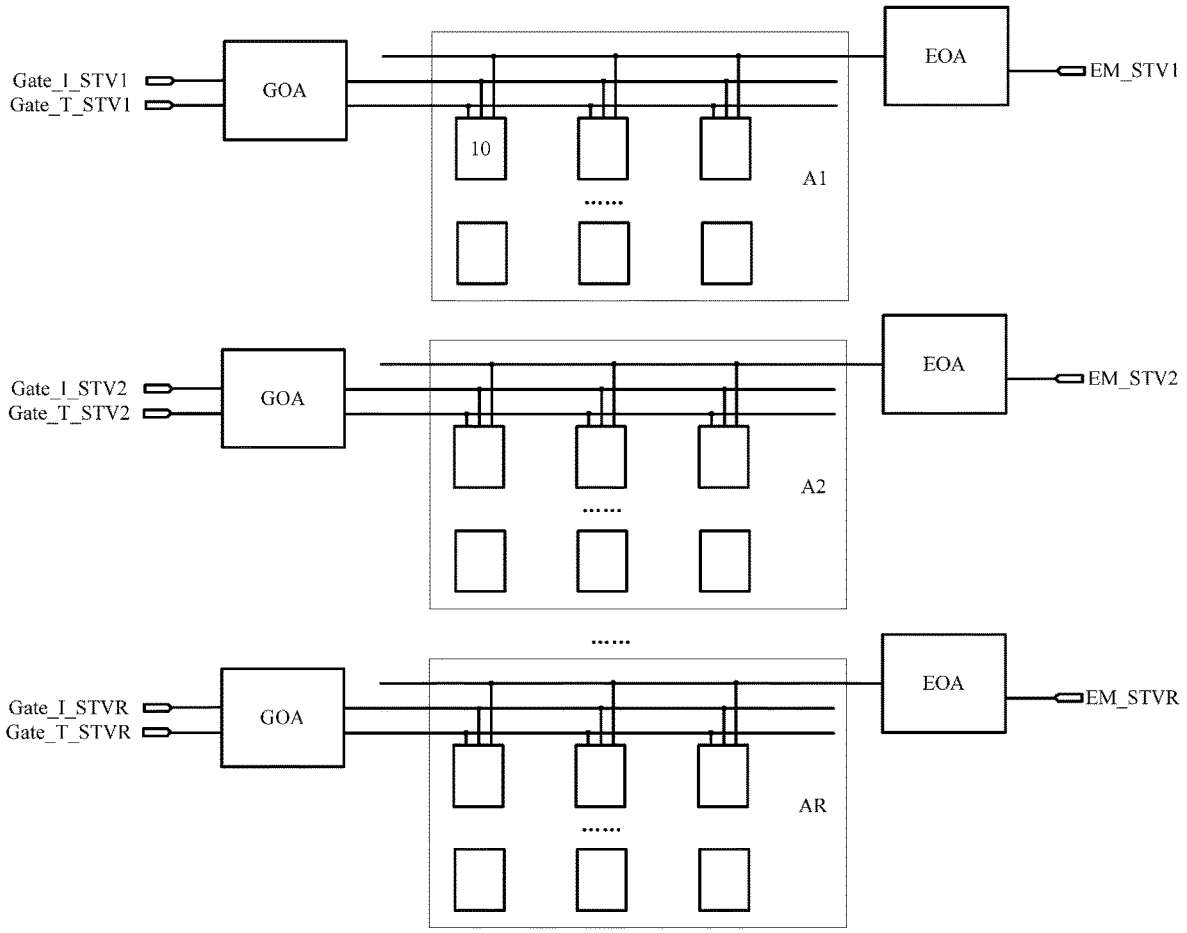
FIG. 1B is another schematic diagram of structure of a display panel according to an embodiment of the present disclosure.

FIG. 1A is a schematic diagram of structure of a display panel according to an embodiment of the present disclosure, and FIG. 1B is another schematic diagram of structure of a display panel according to an embodiment of the present disclosure. As shown in FIGS. 1A and 1B, the display panel according to an embodiment of the present disclosure includes: M rows and N columns of pixel units 10, the display panel is divided into R regions A1 to AR along a column direction, and an i-th region includes: a (1+M(i−1)/R)-th row to a (Mi/R)-th row of pixel units. The display panel further includes: M shift registers GOAs, M light emitting drivers EOAs, R scan start signal terminals for controlling light emission EM_STV1 to EM_STVR, R scan start signal terminals for controlling time length Gate_T_STV1 to Gate_T_STVR, and R scan start signal terminals for controlling current Gate_I_STV1 to Gate_I_STVR.

An i-th row of pixel units is connected with an i-th shift register and an i-th light emitting driver. A light emitting driver EOA connected to a first row of pixel units in the i-th region is connected with an i-th scan start signal terminal for controlling light emission EM_STVi. A shift register GOA connected to the first row of pixel units in the i-th region is connected with an i-th scan start signal terminal for controlling time length Gate_T_STVi and an i-th scan start signal terminal for controlling current Gate_I_STVi, $1 \le i \le R$, $R \ge 2$, $M \ge R$, $N \ge 1$.

In an exemplary embodiment, the shift register GOA includes an input terminal. The i-th scan start signal terminal for controlling time length Gate_T_STVi and the i-th scan start signal terminal for controlling current Gate_I_STVi are connected with the input terminal of the shift register GOA connected to the first row of pixel units in the i-th region.

In an exemplary embodiment, the light emitting driver EOA includes an input terminal. The i-th scan start signal terminal for controlling light emission EM_STVi is connected with the input terminal of the light emitting driver EOA connected to the first row of pixel units in the i-th region.

In an exemplary embodiment, M/R shift registers connected to pixel units located in the same area are cascaded.

In an exemplary embodiment, M/R light emitting drivers connected to pixel units located in the same area are cascaded.

R may be a positive integer greater than or equal to 2, and a value of R is determined according to an actual requirement.

The display panel includes R regions, and different starting signals may be used to drive shift registers and light emission controllers connected with pixel units in different regions, so that multiple rows of pixel units may be driven at the same time, and time occupied by a driving process is reduced to T/R, wherein T is time occupied by a driving process in one frame.

The display panel according to the embodiment of the present disclosure includes M rows and N columns of pixel units, the display panel is divided into R regions along a column direction, and an i-th region includes a (1+M(i−1)/R)-th row to a (Mi/R)-th row of pixel units, and the display panel further includes M shift registers, M light emitting drivers, R scan start signal terminals for controlling light emission, R scan start signal terminals for controlling time length and R scan start signal terminals for controlling current. Herein, an i-th row of pixel units are each connected with an i-th shift register and an i-th light emitting driver, a light emitting driver connected to a first row of pixel units in the i-th region is connected with an i-th scan start signal terminal for controlling light emission, and a shift register connected to the first row of pixel units in the i-th region is connected with an i-th scan start signal terminal for controlling time length and an i-th scan start signal terminal for controlling current. According to the technical solution provided by the present disclosure, the display panel is divided to multiple regions, and different starting signal terminals are adopted to drive shift registers and light emission controllers connected with pixel units in different regions, so that time occupied by a driving process of a pixel circuit in a pixel unit may be reduced to increase light emitting time of a Micro LED, display quality of the display product is raised, and yield of the good display product is improved.

In an exemplary embodiment, the pixel unit includes a light emitting element and a pixel circuit configured to drive the light emitting element to emit light.

Figure 2:
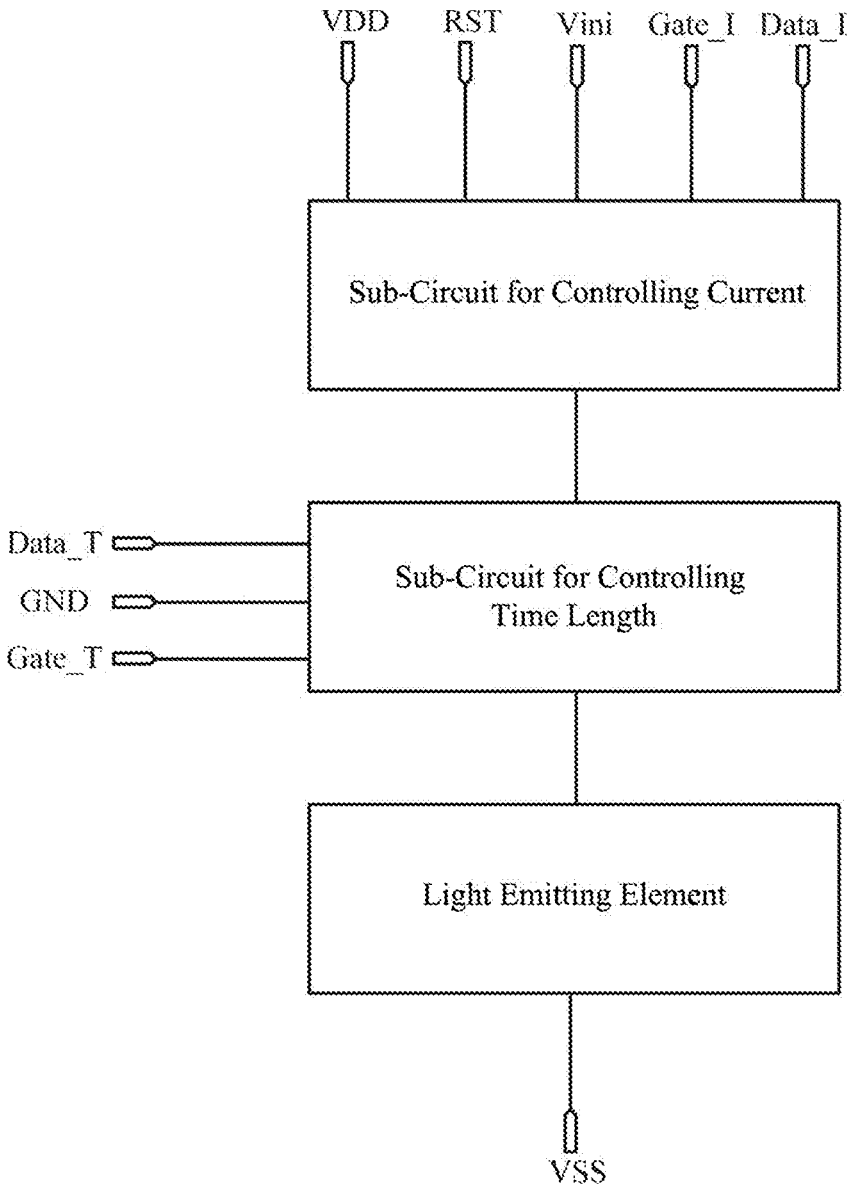
FIG. 2 is a schematic diagram of structure of a pixel circuit according to an exemplary embodiment.

FIG. 2 is a schematic diagram of structure of a pixel circuit according to an exemplary embodiment. As shown in FIG. 2, the pixel circuit according to the exemplary embodiment includes a sub-circuit for controlling current and a sub-circuit for controlling time length.

The sub-circuit for controlling current is connected with a reset signal terminal RST, a first power supply terminal VDD, a light emission control terminal EM (not shown in FIG. 2), a data signal terminal for controlling current Data_I, a scan signal terminal for controlling current Gate_I, an initial signal terminal Vini and the sub-circuit for controlling time length, and is configured to output driving current to the sub-circuit for controlling time length under control of the reset signal terminal RST, the light emission control terminal EM and the scan signal terminal for controlling current GATE_I. The sub-circuit for controlling time length is connected with a ground terminal GND, a data signal terminal for controlling time length Data_T, a scan signal terminal for controlling time length Gate_T and a light emitting element, and is configured to provide driving current to the light emitting element under control of the scan signal terminal for controlling time length GATE_T.

In an exemplary embodiment, the first power supply terminal VDD continuously provides signals at high electrical level.

As shown in FIG. 2, in an exemplary embodiment, the light emitting element is connected with a second power supply terminal VSS.

In an exemplary embodiment, the second power supply terminal VSS continuously provides signals at low electrical level.

In an exemplary embodiment, the light emitting element may be a Micro LED.

In an exemplary embodiment, an anode of the Micro LED is connected with the sub-circuit for controlling time length, and a cathode of the Micro LED is connected with the second power supply terminal VSS.

In an exemplary embodiment, the light emission control terminal EM in each pixel unit is connected with a light emitting driver EOA to which the pixel unit is connected, that is, a signal of the light emission control terminal EM in each pixel unit is provided by the light emitting driver EOA to which the pixel unit is connected.

In an exemplary embodiment, the scan signal terminal for controlling current Gate_I in each pixel unit is connected with a shift register GOA to which the pixel unit is connected, that is, a signal of the scan signal terminal for controlling current Gate_I in each pixel unit is provided by the shift register GOA to which the pixel unit is connected.

In an exemplary embodiment, the scan signal terminal for controlling time length Gate_T in each pixel unit is connected with a shift register GOA to which the pixel unit is connected, that is, a signal of the scan signal terminal for controlling time length Gate_T in each pixel unit is provided by the shift register GOA to which the pixel unit is connected.

The shift register GOA includes an output terminal. The scan signal terminal for controlling current Gate_I is connected with the output terminal of the shift register GOA to which the pixel unit is connected, and the scan signal terminal for controlling time length Gate_T is connected with the output terminal of the shift register GOA to which the pixel unit is connected.

The light emitting driver EOA includes an output terminal. The light emission control terminal EM is connected with the output terminal of the light emitting driver EOA to which the pixel unit is connected.

Different starting signals are provided to a first row of pixel units in each region, the control signals provided to the pixel units may be controlled, R rows of pixel units may be driven at the same time, time occupied by a driving process of the pixel circuit is reduced, a refresh frequency may be increased, and light emitting time may be prolonged.

Figure 3:
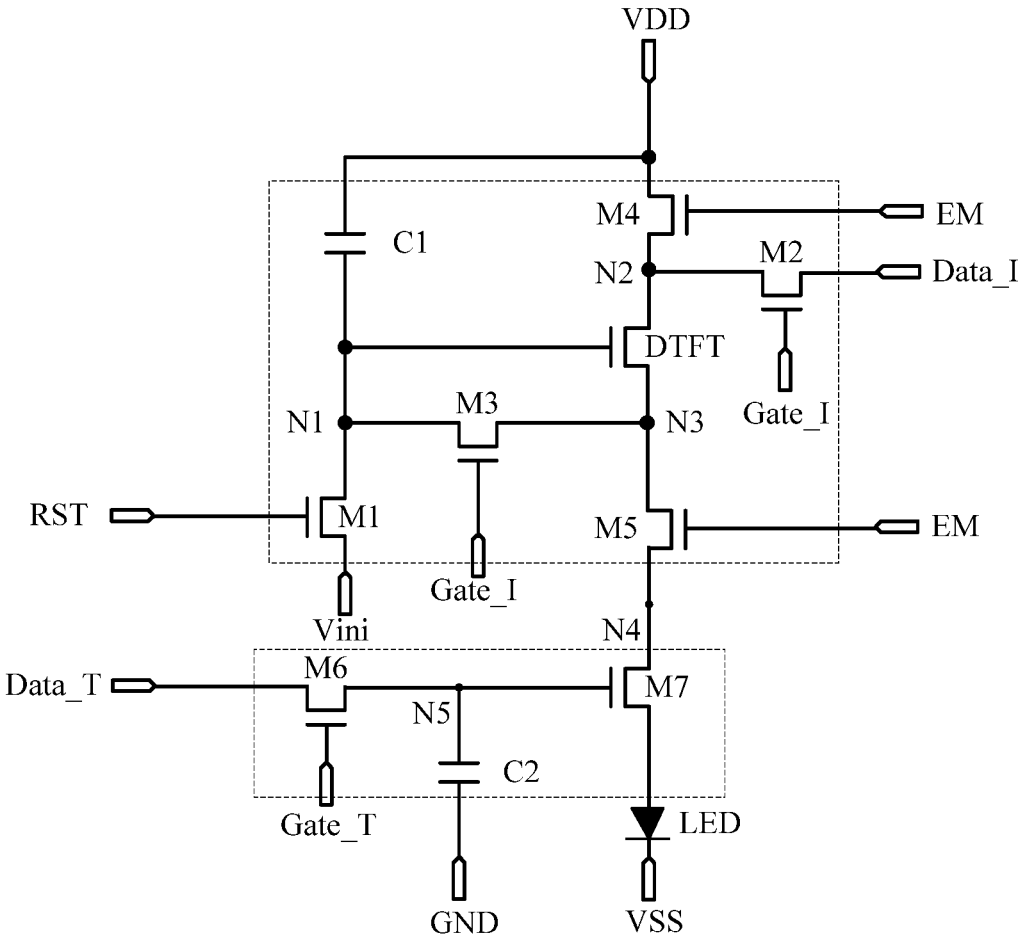
FIG. 3 is an equivalent circuit diagram of a pixel circuit according to an exemplary embodiment.

FIG. 3 is an equivalent circuit diagram of a pixel circuit according to an exemplary embodiment. As shown in FIG. 3, the sub-circuit for controlling current according to the exemplary embodiment includes a first transistor M1, a second transistor M2, a third transistor M3, a fourth transistor M4, a fifth transistor M5, a driving transistor DTFT, and a first capacitor C1. The sub-circuit for controlling time length includes a sixth transistor M6, a seventh transistor M7, and a second capacitor C2.

A control pole of the first transistor M1 is connected with the reset signal terminal RST, a first pole of the first transistor M1 is connected with the initial signal terminal Vini, and a second pole of the first transistor M1 is connected with a first node N1. A control pole of the second transistor M2 is connected with the scan signal terminal for controlling current Gate_I, a first pole of the second transistor M2 is connected with the data signal terminal for controlling current Data_I, and a second pole of the second transistor M2 is connected with a second node N2. A control pole of the third transistor M3 is connected with the scan signal terminal for controlling current Gate_I, a first pole of the third transistor M3 is connected with the first node N1, and a second pole of the third transistor M3 is connected with a third node N3. A control pole of the fourth transistor M4 is connected with the light emission control terminal EM, a first pole of the fourth transistor M4 is connected with the first power supply terminal VDD, a second pole of the fourth transistor M4 is connected with the second node N2. A control pole of the driving transistor DTFT is connected with the first node N1, a first pole of the driving transistor DTFT is connected with the second node N2, and a second pole of the driving transistor DTFT is connected with the third node N3. A first terminal of the first capacitor C1 is connected with the first node N1, and a second terminal of the first capacitor C1 is connected with the first power supply terminal VDD. A control pole of the fifth transistor M5 is connected with the light emission control terminal EM, a first pole of the fifth transistor M5 is connected with the third node N3, and a second pole of the fifth transistor M5 is connected with a fourth node N4. A control pole of the sixth transistor M6 is connected with the scan signal terminal for controlling time length Gate_T, a first pole of the sixth transistor M6 is connected with the data signal terminal for controlling time length Data_T, and a second pole of the sixth transistor M6 is connected with a fifth node N5. A control pole of the seventh transistor M7 is connected with the fifth node N5, a first pole of the seventh transistor M7 is connected with the fourth node N4, and a second pole of the seventh transistor M7 is connected with the light emitting element Micro LED. A first terminal of the second capacitor C2 is connected with the fifth node N5, and a second terminal of the second capacitor C2 is connected with the ground terminal GND.

In an exemplary embodiment, an anode of the micro light-emitting diode is connected with the second pole of the seventh transistor, and a cathode of the micro light-emitting diode is connected with the second power supply terminal.

In an exemplary embodiment, the driving transistor DTFT and the switching transistors M1 to M7 are of the same type, and may be P-type or N-type. The same type of transistors may have a unified and simplified process flow, and is help to improve yield of the good product.

In an exemplary embodiment, the driving transistor or the switching transistors may be a bottom gate structure or may be a top gate structure.

Figure 4:
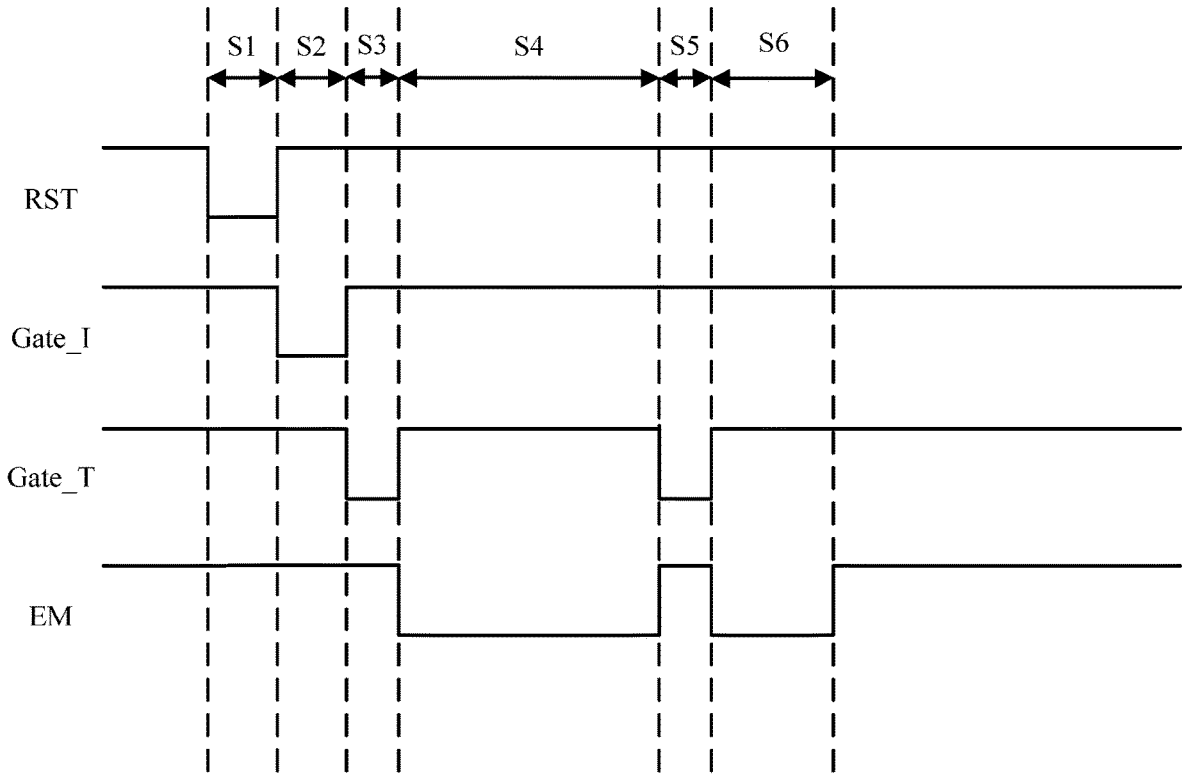
FIG. 4 is an operation sequence diagram of a pixel circuit according to an exemplary embodiment.

Here is an example where the switching transistors M1 to M7 in the pixel circuit according to an exemplary embodiment are all P-type thin film transistors. FIG. 4 is an operation sequence diagram of a pixel circuit according to an exemplary embodiment. As shown in FIGS. 3 and 4, a pixel circuit according to an exemplary embodiment includes 7 switching transistors (M1 to M7), 1 driving transistor (DTFT), 2 capacitance units (C1 and C2), 7 input terminals (Data_I, Gate_I, Data_T, Gate_T, RST, Em and Vini) and 3 power supply terminals (GND, VDD and VSS).

In a first stage S1, an input signal of the reset signal terminal RST is at low electrical level, and the first transistor M1 is turned on to provide a signal of the initial signal terminal Vini to the first node N1 to initialize the first node N1.

In a second stage S2, an input signal of the reset signal terminal RST is at high electrical level, the first transistor M1 is turned off, an input signal of the scan signal terminal for controlling current Gate_I is at low electrical level, the second transistor M2 and the third transistor M3 are turned on, a signal of the data signal terminal for controlling current Data_I is supplied to the second node N2, the first node N1 and the third node N3 are connected, and at this time, the driving transistor DTFT is turned on. A signal of the second node N2 charges the first node N1 until a potential of the first node N1 is equal to difference between the signal of the data signal terminal for controlling current Data_I and a threshold voltage, and the driving transistor DTFT is turned off.

In a third stage S3, an input signal of the scan signal terminal for controlling current Gate_I is at high electrical level, the second transistor M2 and the third transistor M3 are turned off, an input signal of the scan signal terminal for controlling time length Gate_T is at low electrical level, the sixth transistor M6 is turned on, a signal of the data signal terminal for controlling time length Data_T is supplied to the fifth node N5, and the seventh transistor M7 is turned on.

In a fourth stage S4, an input signal of the light emission control terminal EM is at low electrical level, the fourth transistor M4 and the fifth transistor M5 are turned on, and a signal of the first power supply terminal VDD is supplied to the second node N2. As potential difference between potentials of the second node N2 and the first node N1 is greater than the threshold voltage, the driving transistor DTFT is turned on, and a driving current is supplied to the fourth node N4. Under a bootstrap effect of the second capacitor C2, the seventh transistor M7 is still turned on, and a driving current is supplied to the micro light-emitting diode to drive the micro light-emitting diode to emit light.

In a fifth stage S5, an input signal of the scan signal terminal for controlling time length Gate_T is at low electrical level, the sixth transistor M6 is turned on, a signal of the data signal terminal for controlling time length Data_T is supplied to the fifth node N5, and the seventh transistor M7 is turned on.

In a sixth stage S6, an input signal of the light emission control terminal EM is at low electrical level, the fourth transistor M4 and the fifth transistor M5 are turned on, and a signal of the first power supply terminal VDD is supplied to the second node N2. As the potential difference between the potentials of the second node N2 and the first node N1 is greater than the threshold voltage, the driving transistor DTFT is turned on, and a driving current is supplied to the fourth node N4. Under a bootstrap effect of the second capacitor C2, the seventh transistor M7 is still turned on, and a driving current is supplied to the micro light-emitting diode to drive the micro light-emitting diode to emit light.

From the above analysis, it can be seen that the pixel circuit according to an exemplary embodiment inputs data signals in both the second stage and the third stage.

Figure 5:
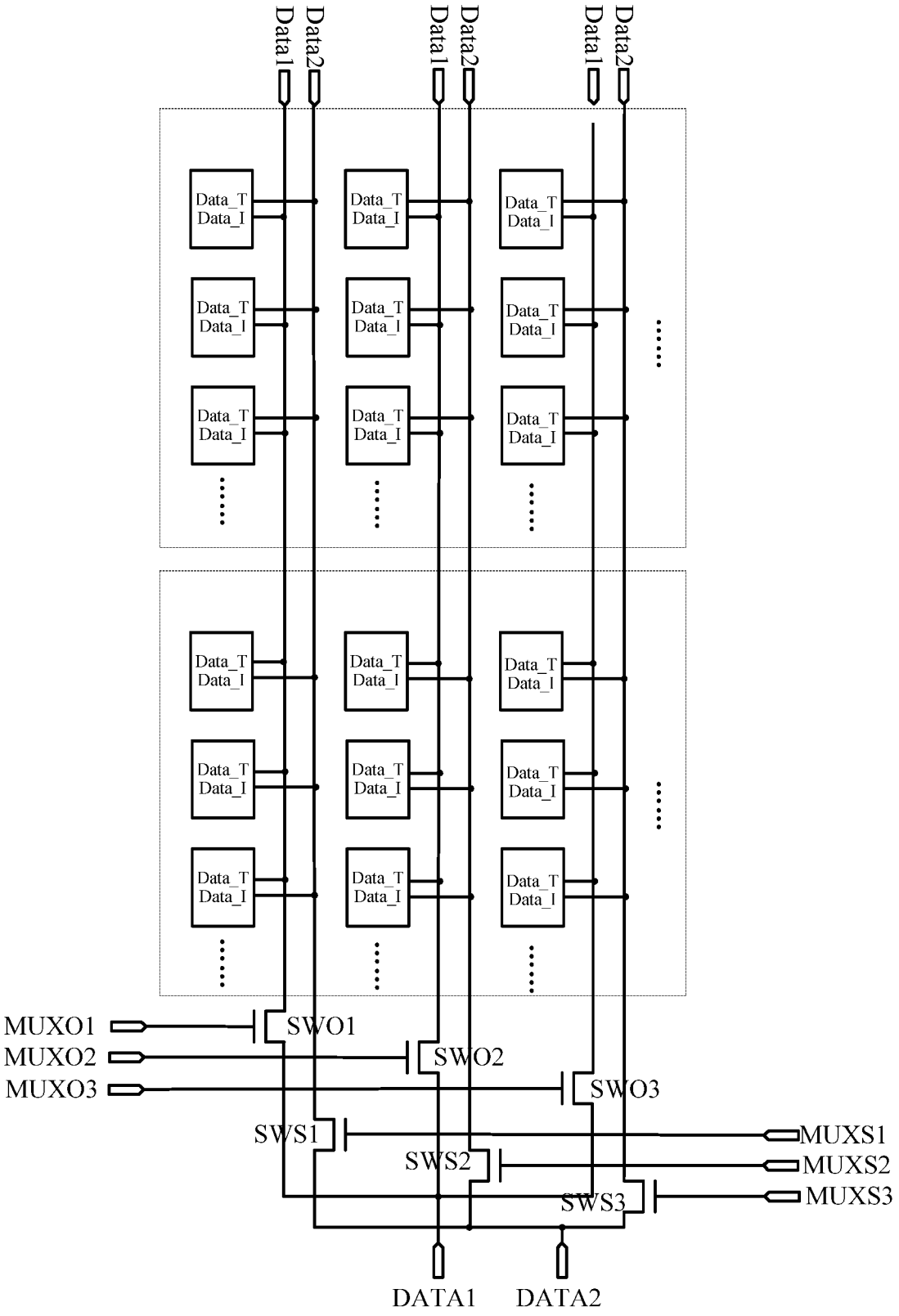
FIG. 5 is a schematic diagram of structure of a display panel according to an exemplary embodiment.

FIG. 5 is a schematic diagram of structure of a display panel according to an exemplary embodiment. As shown in FIG. 5, the display panel according to the exemplary embodiment includes N column data lines, and a j-th of pixel units is connected with a j-th column of data lines, and $1 \leq j \leq N$.

As shown in FIG. 5, in an exemplary embodiment, each column data line includes a first data line Data 1 and a second data line Data 2.

A data signal terminal for controlling current Data_I of a pixel unit in an odd-numbered region is connected with the first data line Data 1, and a data signal terminal for controlling time length Data_T in the pixel unit in the odd-numbered region is connected with the second data line Data 2.

A data signal terminal for controlling current Data_I of a pixel unit in an even-numbered region is connected with the second data line Data 2, and a data signal terminal for controlling time length Data_T in the pixel unit in the even-numbered region is connected with the first data line Data 1.

As shown in FIG. 5, when R=2, the display panel according to an exemplary embodiment further includes a first selection circuit and a second selection circuit.

The first selection circuit includes N first selection control terminals MUXO1 to MUXON and N first selection switches SWO1 to SWON (only MUXO1 to MUXO3, and SWO1 to SWO3 are shown in FIG. 5) An i-th first selection switch SWOi is connected with an i-th first selection control terminal MUXOi, and a first data line Data 1 and the first data terminal DATA 1 of an i-th column of data lines.

In an exemplary embodiment, each first selection switch is a transistor. A control pole of the first selection switch is connected with a first selection control terminal, a first pole of the first selection switch is connected with the first data line, and a second pole of the first selection switch is connected with the first data terminal.

The second selection circuit includes N second selection control terminals MUXS1 to MUXSN and N second selection switches SWS1 to SWSN (only MUXS1 to MUXS3, and SWS1 to SWS3 are shown in FIG. 5). An i-th second selection switch SWSi is connected with an i-th second selection control terminal MUXSi, and a second data line Data 2 and a second data terminal DATA 2 of an i-th column of data lines.

In an exemplary embodiment, each second selection switch is a transistor. A control pole of the second selection switch is connected with a second selection control terminal, a first pole of the second selection switch is connected with the second data line Data 2, and a second pole of the second selection switch is connected with the second data terminal DATA 2.

In an exemplary embodiment, the first data terminal DATA 1 and the second data terminal DATA 2 may be connected with a source driving circuit of the display panel.

In an exemplary embodiment, the first data terminal provides a data signal in the second stage to the data signal terminal for controlling current in the pixel circuit of the pixel unit in the odd-numbered region, and the second data terminal provides a data signal in the third stage to the data signal terminal for controlling time length in the pixel circuit of the pixel unit in the odd-numbered region.

In an exemplary embodiment, the second data terminal provides a data signal in the second stage to the data signal terminal for controlling current in the pixel circuit of the pixel unit in the even-numbered region, and the first data terminal provides a data signal in the third stage to the data signal terminal for controlling time length in the pixel circuit of the pixel unit in the even-numbered region.

In an exemplary embodiment, data signals may be supplied to the data signal terminal for controlling current of the pixel circuit of the pixel unit in the odd-numbered region and the data signal terminal for controlling current of the pixel circuit of the pixel unit in the even-numbered region at the same time.

Figure 6:
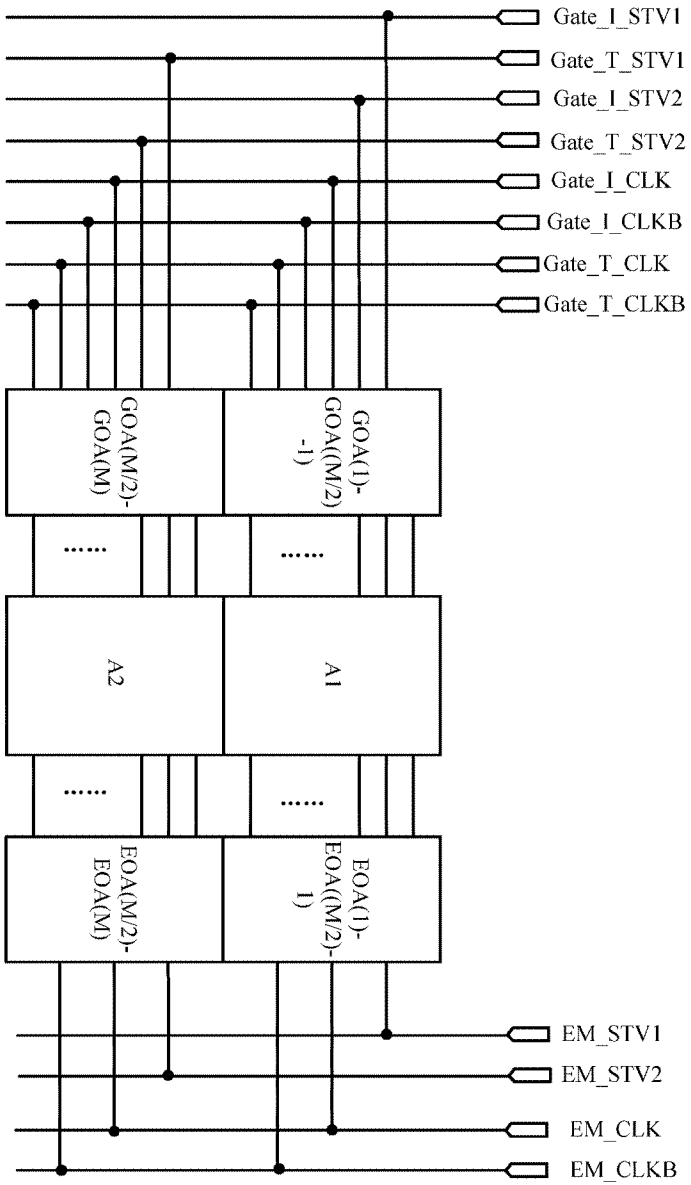
FIG. 6 is a schematic diagram of structure of a display panel according to another exemplary embodiment.
Figure 7:
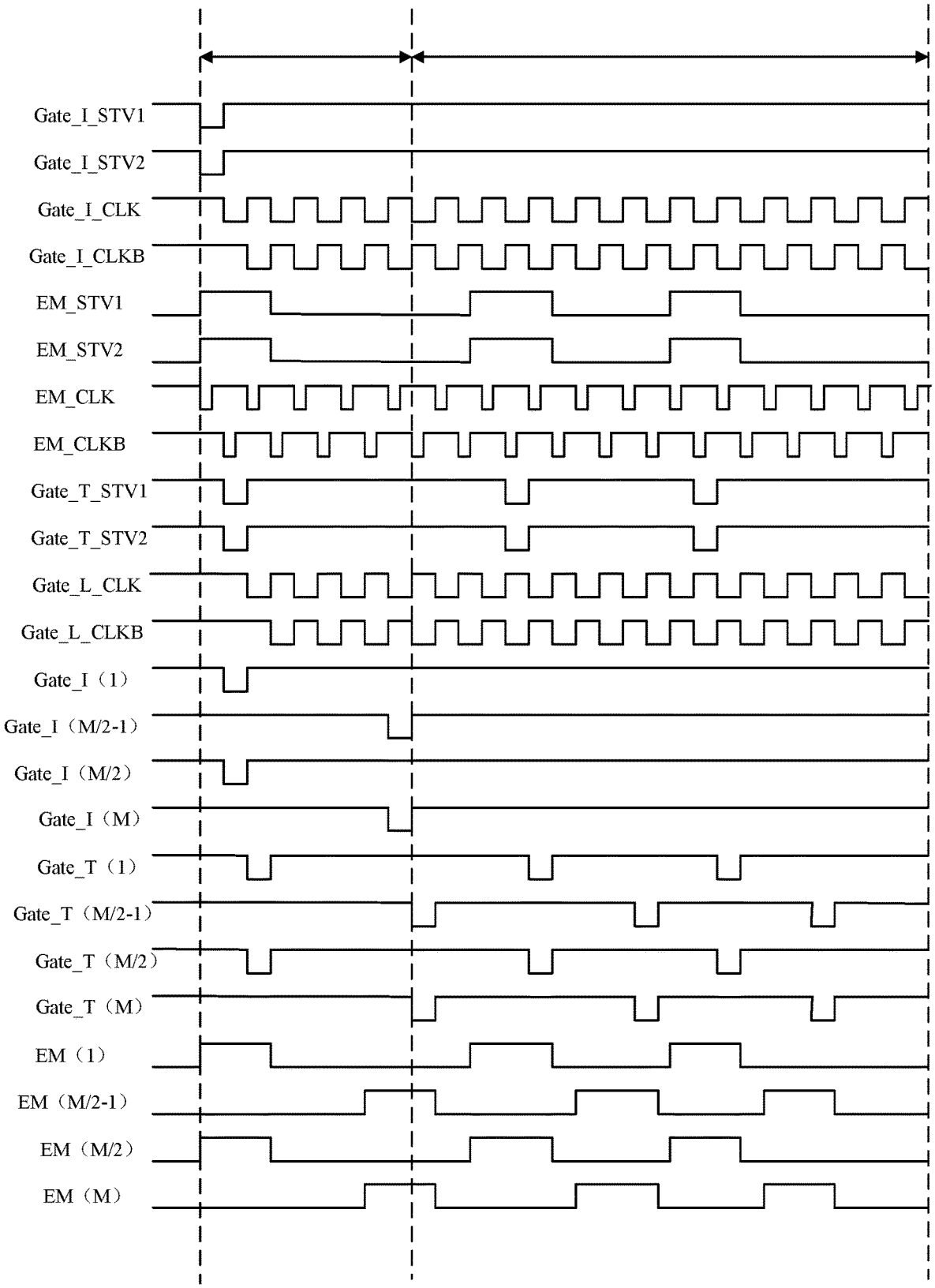
FIG. 7 is an operation sequence diagram of the display panel corresponding to FIG. 6.

FIG. 6 is a schematic diagram of structure of a display panel according to another exemplary embodiment, and FIG. 7 is an operation sequence diagram of the display panel corresponding to FIG. 6. As shown in FIGS. 6 and 7, the display panel according to an exemplary embodiment further includes a first clock signal terminal for controlling current Gate_I_CLK, a second clock signal terminal for controlling current Gate_I_CLKB, a first clock signal terminal for controlling time length Gate_T_CLK, a second clock signal terminal for controlling time length Gate_T_CLKB, a first clock signal terminal for controlling light emission EM_CLK, and a second clock signal terminal for controlling light emission EM_CLKB. FIGS. 6 and 7 are explained by taking R=2 as an example.

For different regions, multiple shift registers GOAs connected with each region are connected with the first clock signal terminal for controlling current Gate_I_CLK, the second clock signal terminal for controlling current Gate_I_CLKB, the first clock signal terminal for controlling time length Gate_T_CLK and the second clock signal terminal for controlling time length Gate_T_CLKB, and multiple light emitting drivers EOAs connected with each region are each connected with the first clock signal terminal for controlling light emission EM_CLK and the second clock signal terminal for controlling light emission EM_CLKB.

In an exemplary embodiment, a signal of the first clock signal terminal for controlling current Gate_I_CLK and a signal of the second clock signal terminal for controlling current Gate_I_CLKB are mutually inverted signals.

In an exemplary embodiment, a signal of the first clock signal terminal for controlling time length Gate_T_CLK and a signal of the second clock signal terminal for controlling time length Gate_T_CLKB are mutually inverted signals.

In an exemplary embodiment, a signal of the first clock signal terminal for controlling light emission EM_CLK and a signal of the second clock signal terminal for controlling light emission EM_CLKB are mutually inverted signals.

As shown in FIG. 7, in an exemplary embodiment, input signals of two scan start signal terminals for controlling light emission are the same.

As shown in FIG. 7, in an exemplary embodiment, input signals of two scan start signal terminals for controlling time length are the same.

As shown in FIG. 7, in an exemplary embodiment, input signals of two scan start signal terminals for controlling current are the same.

In FIG. 7, Gate_T(i) represents an output signal of an i-th shift register, i.e., a signal supplied to a scan signal terminal for controlling time length of a pixel circuit in an i-th row of pixel units, Gate_I(i) represents an output signal of an i-th shift register, i.e., a signal supplied to a scan signal terminal for controlling current of a pixel circuit in an i-th row of pixel units, and EM(i) represents an output signal of an i-th light emitting driver, i.e., a signal supplied to a light emission control terminal of a pixel circuit in an i-th row of pixel units.

Figure 8:
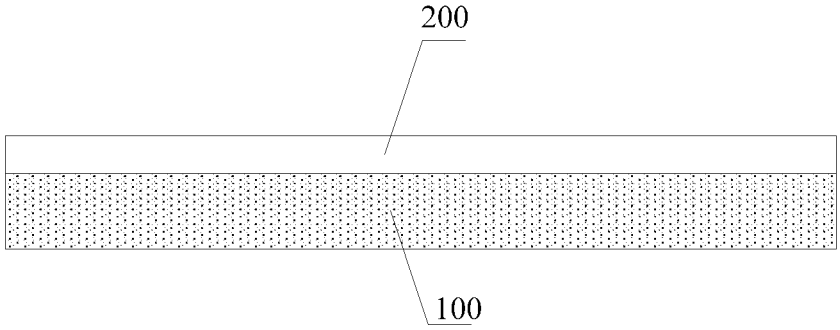
FIG. 8 is a schematic diagram of structure of a display device according to an embodiment of the present disclosure.

FIG. 8 is a schematic diagram of structure of a display device according to an embodiment of the present disclosure. As shown in FIG. 8, the display device according to an embodiment of the present disclosure includes a display panel 100 and a protective cover plate 200.

In an exemplary embodiment, the protective cover plate 200 is located at a light emitting layer of the display panel 100 and is configured to protect the display panel 100.

In an exemplary embodiment, the protective cover 200 may be a glass cover.

In an exemplary embodiment, the display device may be a mobile phone, a tablet computer, a television, a display, a notebook computer, a digital photo frame, or a navigator.

The display panel is the display panel according to any of the previous embodiments, of which implementation principle and effect are similar, thus is not repeatedly described herein.

The accompanying drawings in the present disclosure only refer to structures involved in the embodiments of the present disclosure, and other structures may refer to common designs.

Although the embodiments disclosed in the present disclosure are as the above, the described contents are only embodiments for facilitating understanding the present disclosure and are not used to limit the present disclosure. Any person skilled in the field to which the present disclosure pertains may make any modifications and variations in the forms and details of implementation without departing from the spirit and the scope disclosed in the present disclosure, but the patent protection scope of the present disclosure should still be subject to the scope defined by the appended claims.

What we claim is:

1. A display panel comprising: M rows and N columns of pixel units;

the display panel being divided into R regions along a column direction;

an i-th region comprising: a (1+M(i−1)/R)-th row to a (Mi/R)-th row of pixel units;

the display panel further comprising: R shift registers, R light emitting drivers, R scan start signal terminals for controlling light emission of pixel units in the R regions, R scan start signal terminals for controlling time length of pixel units in the R regions, and R scan start signal terminals for controlling current of pixel units in the R regions;

an i-th row of pixel units being connected with an i-th shift register and an i-th light emitting driver; and a light emitting driver connected to a first row of pixel units in the i-th region being connected with an i-th scan start signal terminal for controlling light emission of pixel units in the i-th region, a shift register connected to the first row of pixel units in the i-th region being connected with an i-th scan start signal terminal for controlling time length of pixel units in the i-th region and an i-th scan start signal terminal for controlling current of pixel units in the i-th region, wherein $1 \leq i \leq R$, $R \geq 2$, $M \geq R$, $N \geq 1$, and each of i and M/R is a positive integer.

2. The display panel according to claim 1, wherein the pixel unit comprises a light emitting element and a pixel circuit configured to drive the light emitting element to emit light.

3. The display panel according to claim 2, wherein the pixel circuit comprises a sub-circuit for controlling current and a sub-circuit for controlling time length;

the sub-circuit for controlling current is connected with a reset signal terminal, a first power supply terminal, a light emission control terminal, a data signal terminal for controlling current, a scan signal terminal for controlling current, an initial signal terminal and the sub-circuit for controlling time length, and is configured to output driving current to the sub-circuit for controlling time length under control of the reset signal terminal, the light emission control terminal and the scan signal terminal for controlling current; and the sub-circuit for controlling time length is connected with a ground terminal, a data signal terminal for controlling time length, a scan signal terminal for controlling time length and the light emitting element, and is configured to provide driving current to the light emitting element under control of the scan signal terminal for controlling time length.

4. The display panel according to claim 3, wherein the light emitting element is connected with a second power supply terminal.

5. The display panel according to claim 4, wherein for each pixel unit, the light emission control terminal is connected with a light emitting driver to which the pixel unit is connected.

6. The display panel according to claim 4, wherein for each pixel unit, the scan signal terminal for controlling current is connected with a shift register to which the pixel unit is connected.

7. The display panel according to claim 4, wherein for each pixel unit, the scan signal terminal for controlling time length is connected with a shift register to which the pixel unit is connected.

8. The display panel according to claim 3, wherein the sub-circuit for controlling current comprises a first transistor, a second transistor, a third transistor, a fourth transistor, a fifth transistor, a driving transistor, and a first capacitor;

a control pole of the first transistor is connected with the reset signal terminal, a first pole of the first transistor is connected with the initial signal terminal, and a second pole of the first transistor is connected with a first node;

a control pole of the second transistor is connected with the scan signal terminal for controlling current, a first pole of the second transistor is connected with the data signal terminal for controlling current, and a second pole of the second transistor is connected with a second node;

a control pole of the third transistor is connected with the scan signal terminal for controlling current, a first pole of the third transistor is connected with the first node, and a second pole of the third transistor is connected with a third node;

a control pole of the fourth transistor is connected with the light emission control terminal, a first pole of the fourth transistor is connected with the first power supply terminal, and a second pole of the fourth transistor is connected with the second node;

a control pole of the fifth transistor is connected with the light emission control terminal, a first pole of the fifth transistor is connected with the third node, and a second pole of the fifth transistor is connected with a fourth node;

a control pole of the driving transistor is connected with the first node, a first pole of the driving transistor is connected with the second node, and a second pole of the driving transistor is connected with the third node; and a first terminal of the first capacitor is connected with the first node, and a second terminal of the first capacitor is connected with the first power supply terminal.

9. The display panel according to claim 3, wherein the sub-circuit for controlling time length comprises a sixth transistor, a seventh transistor, and a second capacitor;

a control pole of the sixth transistor is connected with the scan signal terminal for controlling time length, a first pole of the sixth transistor is connected with the data signal terminal for controlling time length, and a second pole of the sixth transistor is connected with a fifth node;

a control pole of the seventh transistor is connected with the fifth node, a first pole of the seventh transistor is connected with the fourth node, and a second pole of the seventh transistor is connected with the light emitting element; and a first terminal of the second capacitor is connected with the fifth node, and a second terminal of the second capacitor is connected with the ground terminal.

10. The display panel according to claim 3, wherein the sub-circuit for controlling current comprises a first transistor, a second transistor, a third transistor, a fourth transistor, a fifth transistor, a driving transistor, and a first capacitor; the sub-circuit for controlling time length comprises a sixth transistor, a seventh transistor and a second capacitor;

a control pole of the first transistor is connected with the reset signal terminal, a first pole of the first transistor is connected with the initial signal terminal, and a second pole of the first transistor is connected with a first node;

a control pole of the second transistor is connected with the scan signal terminal for controlling current, a first pole of the second transistor is connected with the data signal terminal for controlling current, and a second pole of the second transistor is connected with a second node;

a control pole of the third transistor is connected with the scan signal terminal for controlling current, a first pole of the third transistor is connected with the first node, and a second pole of the third transistor is connected with a third node;

a control pole of the fourth transistor is connected with the light emission control terminal, a first pole of the fourth transistor is connected with the first power supply terminal, and a second pole of the fourth transistor is connected with the second node;

a control pole of the fifth transistor is connected with the light emission control terminal, a first pole of the fifth transistor is connected with the third node, and a second pole of the fifth transistor is connected with a fourth node;

a control pole of the driving transistor is connected with the first node, a first pole of the driving transistor is connected with the second node, and a second pole of the driving transistor is connected with the third node;

a first terminal of the first capacitor is connected with the first node, and a second terminal of the first capacitor is connected with the first power supply terminal;

a control pole of the sixth transistor is connected with the scan signal terminal for controlling time length, a first pole of the sixth transistor is connected with the data signal terminal for controlling time length, and a second pole of the sixth transistor is connected with a fifth node;

a control pole of the seventh transistor is connected with the fifth node, a first pole of the seventh transistor is connected with the fourth node, and a second pole of the seventh transistor is connected with the light emitting element; and a first terminal of the second capacitor is connected with the fifth node, and a second terminal of the second capacitor is connected with the ground terminal.

11. The display panel according to claim 10, wherein the light emitting element is a micro light-emitting diode.

12. The display panel according to claim 11, wherein an anode of the micro light-emitting diode is connected with the second pole of the seventh transistor, a cathode of the micro light-emitting diode is connected with a second power supply terminal.

13. The display panel according to claim 3, wherein the display panel comprises N columns of data lines, a j-th column of pixel units connected with a j-th column of data lines, and $1 \leq j \leq N$.

14. The display panel according to claim 13, wherein each column of data lines comprises: a first data line and a second data line;

a data signal terminal for controlling current of a pixel unit in an odd-numbered region is connected with the first data line, and a data signal terminal for controlling time length of the pixel unit in the odd-numbered region is connected with the second data line; and a data signal terminal for controlling current of a pixel unit in an even-numbered region is connected with the second data line, and a data signal terminal for controlling time length of the pixel unit in the even-numbered region is connected with the first data line.

15. The display panel according to claim 14, wherein the display panel further comprises: a first selection circuit; and the first selection circuit comprises N first selection control terminals and N first selection switches, and an i-th first selection switch is connected with an i-th first selection control terminal, and a first data line and a first data terminal of an i-th column of data lines.

16. The display panel according to claim 15, wherein the display panel further comprises: a second selection circuit; and the second selection circuit comprises N second selection control terminals and N second selection switches, and an i-th second selection switch is connected with an i-th second selection control terminal, a second data line and a second data terminal of an i-th column of data lines.

17. The display panel according to claim 1, wherein when R=2, input signals of two scan start signal terminals for controlling light emission are the same.

18. The display panel according to claim 1, wherein when R=2, input signals of two scan start signal terminals for controlling time length are the same.

19. The display panel according to claim 1, wherein when R=2, input signals of two scan start signal terminals for controlling current are the same.

20. A display device comprising: the display panel according to claim 1 and a protective cover plate; and the protective cover plate is positioned on a light emitting side of the display panel.

* * * * *